United States Patent [19]

Fayolle et al.

[11] Patent Number: 4,850,426

[45] Date of Patent: Jul. 25, 1989

[54] GAS/LIQUID HEAT EXCHANGER WITH CONDENSATION

[75] Inventors: Lucien Fayolle, Saint Martin Le Vinoux; Patrick Mangin, Grenoble; Guy Nineuil, Seyssins Village, all of France

[73] Assignee: Vicarb, France

[21] Appl. No.: 263,391

[22] Filed: Oct. 27, 1988

[30] Foreign Application Priority Data

Oct. 29, 1987 [FR] France ..... 8715245

[51] Int. Cl.[4] ..... F28B 1/02

[52] U.S. Cl. ..... 165/111; 165/174; 165/165; 165/160

[58] Field of Search ..... 165/110, 111, 174, 165, 165/159, 160

[56] References Cited

U.S. PATENT DOCUMENTS

| | | | |
|---|---|---|---|
| 456,923 | 7/1891 | Barnstead | 165/160 |
| 1,235,908 | 8/1917 | Lovekin | 165/174 |
| 1,566,528 | 12/1925 | Egloff | 165/159 |
| 2,821,369 | 1/1958 | Hilliard | 165/159 |
| 2,887,303 | 5/1959 | Reys | 165/82 |
| 2,941,787 | 6/1960 | Ramen | 165/165 |
| 3,315,739 | 4/1967 | Kearney | 165/165 |
| 3,532,160 | 10/1970 | Garrison | 165/159 |
| 3,675,710 | 7/1972 | Ristow | 165/1 |

FOREIGN PATENT DOCUMENTS

| | | | |
|---|---|---|---|
| 0196548 | 10/1986 | European Pat. Off. . | |
| 601049 | 8/1934 | Fed. Rep. of Germany | 165/160 |
| 2161604 | 6/1973 | Fed. Rep. of Germany . | |
| 2034392 | 12/1970 | France . | |
| 2562997 | 10/1985 | France . | |
| 7810186 | 10/1978 | Netherlands . | |
| 2087526 | 10/1980 | United Kingdom . | |

*Primary Examiner*—Ira S. Lazarus
*Assistant Examiner*—Christopher Hayes
*Attorney, Agent, or Firm*—Wall and Roehrig

[57] ABSTRACT

Gas/liquid heat exchanger with condensation.

It is presented in the form of blocks juxtaposed (1) within an enclosure (2) and in which two series of channels (3,4) are pierced, these blocks (1) being disposed within an enclosure (2), the space between the enclosure (2) and the central column which the blocks form being separated into two chambers (6,7), connected respectively to the gaseous phase supply circuit (10) and the other to the circuit (14) for the evacuation of the condensates formed.

4 Claims, 2 Drawing Sheets

GAS/LIQUID HEAT EXCHANGER WITH CONDENSATION

The present invention relates to an improvement made to gas/liquid heat exchangers in which the heat exchange involves a total condesation of the gas.

In addition to plate exchangers and conventional tubular exchangers, it has been proposed for a great length of time, especially by the Applicant, to construct heat exchangers consisting of parallelepipedic or cylindrical graphite blocks, in which two series of channels are pierced, in general of cylindrical shape and disposed orthogonally in relation to one another in such a manner as to construct independent circuits for the two fluids between which the heat exchange is to take place. Such blocks, which exhibit the advantage of being able to be mass produced in series and of being interchangeable, not only permit a very large heat exchange surface to be obtained but also permit the construction of exchangers which can easily be adapted, depending upon the particular applications for which the exchanger is to be constructed, since it is presented in the form of modules which it is sufficient to stack within an enclosure defining the independent chambers for the circulation of the fluids. Moreover, it is clear that the sealing problems are perfectly resolved, given that the channels for the circulation of fluid are pierced in the mass.

Such exchangers are used in very numerous fields, for example to ensure the heating of a liquid (an acid solution of low concentration, for example), this taking place by means of a gas at high temperature (in general, water vapor).

The principal problems which arise with such exchangers are, on the one hand, that of the regular flow of the condensates formed from the gaseous phase entering in the course of the heat exchange, in order to eliminate any risk of vibration or of rm shocks which are particularly troublesome when the materials employed to construct the block are sensitive to shocks (which is the case with graphite, for example) and, on the other hand, that of the regular distribution of the gaseous phase entering over the entire height of the exchanger.

Now, and it is this which forms the subject of the present invention, an improvement has been found to this type of exchanger consisting of blocks pierced with two series of channels permitting the construction of independent circuits for the circulation of gas and of liquid to be heated and which permits the resolution of all these problems.

In a general way, the gas/liquid heat exchanger according to the invention is of the type consisting of modular elements in the form of blocks juxtaposed within an enclosure and in which two series of channels are pierced, one extending over the entire height of the blocks and theother over their entire width, and permitting respectively the circulation of the liquid phase and of the gaseous phase between which the heat exchange is to be performed:

said blocks being disposed within the enclosure in such a manner as to form a column connected at its base and at its upper part to the circuit permitting the supply and the circulation of the liquid phase within the longitudinal conduits;

the space between the enclosure and the aforementioned central column being separated into two chambers, one referred to as the admission chamber, being connected to the gaseous phase supply circuit and the other refered to as the recovery chamber, being connected to the circuit for the evacuation of the condensates formed in the course of the heat exchange.

The exchanger according to the invention is defined in that:

the introduction of the gaseous phase into the admission chamber is undertaken by means of a distribution box permitting the distribution of said gaseous phase over the entire height of this chamber;

the transverse conduits pierced in the exchange blocks per se and which connect the admission chamber to the recovery chamber exhibit a slight slope descending in the sense of the circulation of the liquid phase which is formed by condensation from the gaseous phase entering.

Advantageously and in practice:

the exchange blocks and the enclosure which surrounds them are present in the cylindrical form; it is clear that it is likewise possible to construct said exchanger according to the invention in a form other than cylindrical;

the box for the distribution of the gaseous phase over the entire height of the exchanger is disposed outside the enclosure, vertical slits being provided on said enclosure in order to distribute the gas over the entire height of the chamber, at least one deflector being furthermore disposed, opposite said slits, in the space contained between the outer enclosure and the central exchange column, in order to distribute the gas over the entire suface of the column disposed within the admission chamber.

The invention and the advantages which it provides will however be better understood with reference to the illustrative embodiment given hereinbelow on an indicative but non-limiting basis, and which is illustrated by the accompanying figures, in which.

Figure 1:
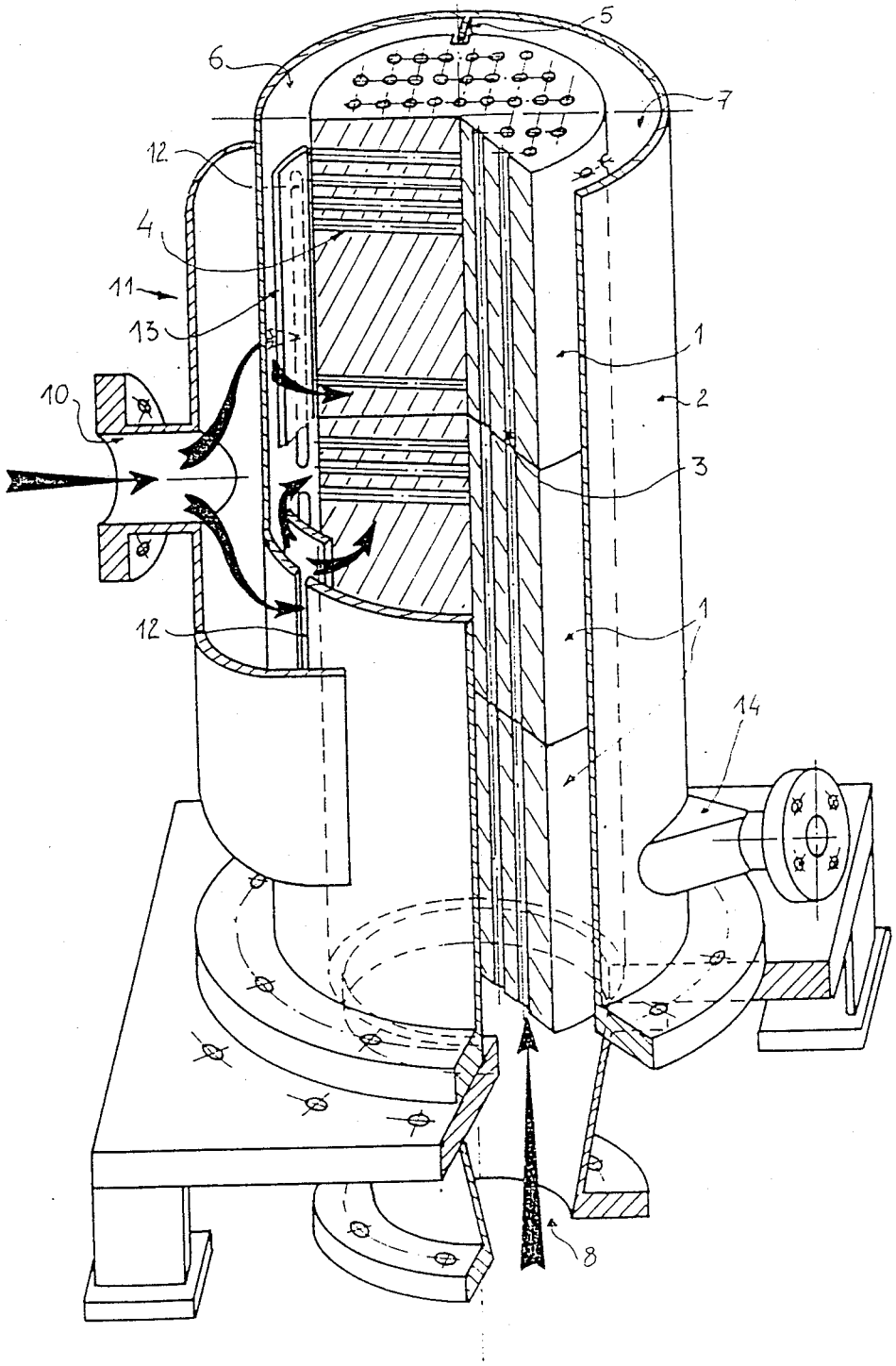
FIG. 1 is a perspective cut-away diagrammatic view of the assembly of an exchanger according to the invention.

If reference is made to the accompanying diagrams, and more particularly to FIG. 1, the exchanger according to the invention is of the type consisting of modular elements (1), which are present in the form of blocks, numbering three in the example illustrated in FIG. 1, maintained juxtaposed within an enclosure (2). These modular elements (1) consist of a block of material selected as a function of the nature of the fluids or gases between which the heat exchange is to be performed and which, in the present case, is graphite. The blocks (1) are pierced by two series of channels (3,4) permitting the construction of independent circuits for the gas and the liquid.

In the illustrated embodiment, the blocks (1) and the casing (2) are of cylindrical form, but it is clear that the exchanger might have an entirely different form, for example parallelepipedic. The channels (3), referred to as "longitudinal channels", extend parallel to the axis of revolution of the blocks, while the channels (4) referred to as "transverse channels" are disposed parallel to one another between each series of longitudinal channels (3).

The blocks constituting the entire exchange assembly are disposed within the enclosure (2) in such a manner as to form a central column. The blocks (1) are mounted within the casing by means of slideways (5) (only one being represented in FIG. 1) extending over the entire height of the column. These slideways (5) permit the formation of two chambers separated from one another in the space contained between the periphery of the central column and the casing, one referred to as the admission chamber (6), and the other referred to as the recovery chamber (7). The supply of the liquid phase through the longitudinal conduits (3) is undertaken through the base of the assembly by means of an appropriate supply circuit (8), connected to a liquid supply circuit, the evacuation being performed through the upper part by means of an evacuation conduit (9) (not represented in FIG. 1).

Figure 3:
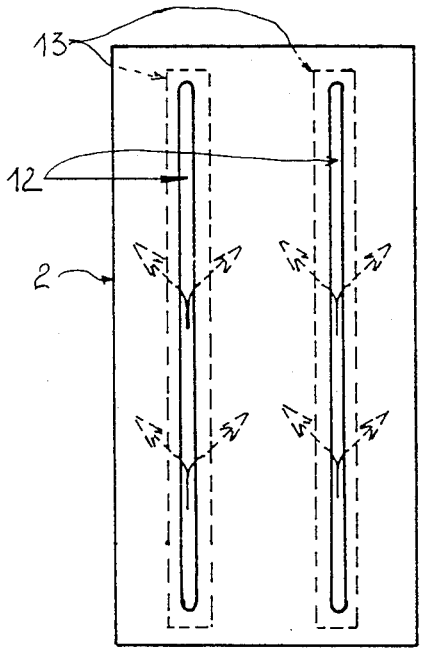
FIG. 3 is a detailed view of the distribution system permitting the distribution of the gaseous phase over the entire height of the exchanger.

According to the invention, in order to ensure a regular distribution within the admission chamber (6), of the gaseous phase intended to heat the liquid phase circulating within the conduits (3), the supply of the admission chamber (6) is undertaken indirectly by causing the conduit (10) for the supply of this gaseous phase to open not directly within the space contained between the exchange zone and the casing, but in a distribution box (11) provided outside said casing (2). This distribution box (11), which partially surrounds the casing, extends over virtually its entire height. The introduction of the gaseous phase within the admission chamber (6) is performed by providing on the casing a passage (12), in the form of a slit. This passage (12) in the form of a slit can either be continuous and extend over the entire height (see FIG. 3) or consist of a plurality of slits disposed in the extension of one another, for example numbering two as represented in FIG. 1. By virtue of such an embodiment, the distribution of the gaseous phase is undertaken over the entire height of the exchanger. On the other hand, in order to ensure a good distribution over the entire periphery of the blocks, deflectors in the form of plates (13) may be disposed, within the free space contained between the central column and the casing, opposite the slits for the introduction of the gaseous phase. By virtue of such an embodiment, the gaseous phase is not only regularly distributed over the entire height of the exchange blocks (1), but equally over the entire peripheral surface of said blocks situated in the admission chamber (6).

Figure 2:
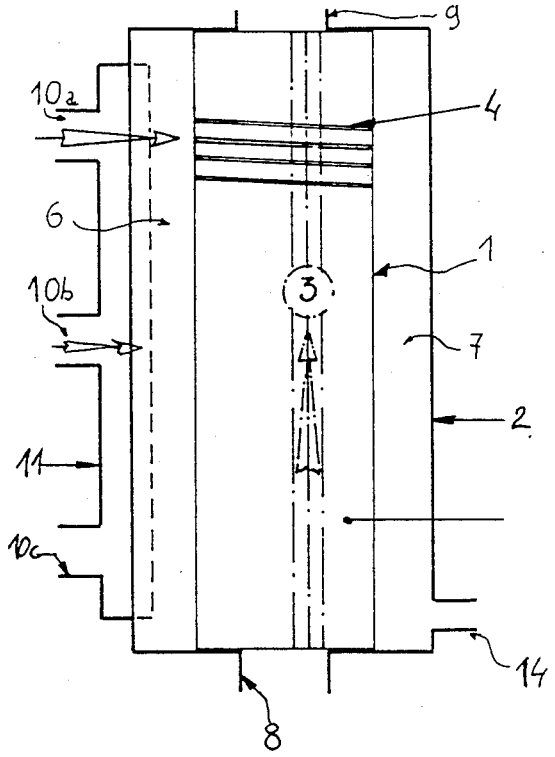
FIG. 2 is a diagrammatic view, in cross-section according to the plane AA of FIG. 1, illustrating the manner in which the heat exchange is performed.

In the exchamber according to the invention, the introduction of the gas phase may be undertaken either by means of a single conduit (10), disposed in this case substantially at mid-height of the exchanger, as representec in FIG. 1, or possibly, as has been represented in FIG. 2, by means of a plurality of conduits (10*a*, 10*b*, 10*c*) distributed over the height of the distribution box.

On the other hand, according to a further feature of the exchanger according to the invention, the transverse channels (4), the cross-section of which may be either circular, elliptical . . . , are not disposed horizontally, but exhibit a slight slope descending in the sense of the circulation of the liquid phase which is formed by condensation from the gaseous phase entering. In general, a slope in the order of 2° to 3° is entirely appropriate.

The evacuation of the condensates formed from within the recovery chamber (7) is obtained by means of an evacuation conduit (14) provided at the base of the recovery chamber.

The cross-sections of the supply (10) and evacuation (14) conduits will be calculated as a function of the throughput of the gaseous phase in a cross-sectional ratio of one third for the evacuation conduit (14) to two thirds for the admission conduit (10) appropriate for the majority of applications.

By virtue of such a structure, it is possible to obtain an exchanger of a high efficiency and in which the flow of the condensates within the transverse conduits (4) is undertaken in a regular manner by eliminating any risk of vibration or of ram shocks, these being phenomena which are particularly harmful when the blocks (1) are based on materials which are very sensitive to shocks; this is so in the case of graphite. Moreover, such a type of exchanger permits better performance levels, by virtue of the optimization of the surface associated with the condensation.

The invention is not, of course, limited to the embodiment described hereinabove, but it covers all the variants there are which are constructed in the same spirit.

What is claimed is:

1. A gas phase and liquid phase heat exchanger with condensation of the type having a plurality of modular elements in the form of blocks juxtaposed within an enclosure, so that hot gases may be circulated through one set of channels and cool liquid to be heated may be circulated through another set of channels comprising:
   - an enclosure;
   - a plurality of blocks disposed within the enclosure;
   - a plurality of vertical channels formed in each of said blocks, said blocks being disposed to align said channels to form columns extending from the bottom to the top of said plurality of blocks;
   - a plurality of transverse channels extending through said blocks at a small downwardly sloping angle to said vertical channels,
   - a pair of wall members dividing the space between said enclosure and blocks into two chambers, one admission chamber encompassing the input side of said transverse channels, and one recovery chamber encompassing the output side of said transverse channels;
   - gas means attached to said admission chamber to distribute the gas over the entire height of the admission chamber so as to permit hot gases to enter the transverse channels within the plurality of juxtaposed blocks;
   - input pipe means connected to said gas distribution means for introducing the heating gas into said heat exchanger;
   - output pipe means connected to said recovery chamber for evacuation of condensates and cooled gases;
   - fluid input means located at the lower end of said enclosure for introduction of the liquid to be heated into the vertical channels in said blocks; and
   - fluid output means connected to the upper end of said enclosure for conveying the heated liquid output from said heat exchanger.

2. The heat exchanger as claimed in claim 1 wherein the modular blocks are cylindrical and the enclosure surrounding the blocks is cylindrical and of a greater diameter than the blocks.

3. A heat exchanger as claimed in claim 1 wherein said gas input means comprises a gas distribution chamber mounted outwardly of said admission chamber and in communication therewith, a plurality of apertures in said enclosure within said admission chamber and at least one baffle mounted inwardly of said enclosure in spaced, but close juxtaposition to at least one of said apertures for deflecting gases throughout the entire height of said blocks.

4. A heat exchanger as claimed in claim 1 wherein the slope of the downwardly directed transverse channels are sloped downward two to three degrees from the horizontal so that condensate will flow to the output pipe means connected to said recovery chamber.

* * * * *